US005525867A

United States Patent [19]

Williams

[11] Patent Number: 5,525,867

[45] Date of Patent: Jun. 11, 1996

[54] ELECTROLUMINESCENT DISPLAY WITH INTEGRATED DRIVE CIRCUITRY

[75] Inventor: Ronald L. Williams, San Marcos, Calif.

[73] Assignee: Hughes Aircraft Company, Los Angeles, Calif.

[21] Appl. No.: 286,827

[22] Filed: Aug. 5, 1994

[51] Int. Cl.[6] ..... G09G 3/10

[52] U.S. Cl. ..... 315/169.3; 445/1; 313/505; 313/506; 313/509

[58] Field of Search ..... 315/169.1, 169.3; 313/500, 502, 503, 505, 506; 340/324 R, 719, 784; 445/1; 437/21

[56] References Cited

U.S. PATENT DOCUMENTS

| | | | |
|---|---|---|---|
| 4,006,383 | 2/1977 | Luo et al. | 315/169.3 X |
| 4,808,983 | 2/1989 | Benjamin et al. | 340/719 |
| 4,977,350 | 12/1990 | Tanaka et al. | 313/505 |
| 5,317,236 | 5/1994 | Zavracky et al. | 315/169.3 |

*Primary Examiner*—Robert Pascal
*Assistant Examiner*—Haissa Philogene
*Attorney, Agent, or Firm*—M. E. Lachman; M. W. Sales; W. K. Denson-Low

[57] ABSTRACT

An electroluminescent display and method of fabricating the same is described in which an active driver panel (14) is integrated with a processed display panel (12) using a unique application of semiconductor wafer technology. A microelectronic driver circuit (32) and back electrode (34) are fabricated on a semiconductor wafer (30) to provide a panel for driving the display. Multiple driver circuits (32) and respective back electrodes (34) may be arranged on the wafer to form an active-matrix electroluminescent display. The display panel (12) includes a front electrode (18) and an adjacent phosphor panel (20) for illuminating the display. The driver panel (14) is adhered to the display panel (12) using either an indium bump connection or a thermal bond, which provide both mechanical and electrical coupling between the back electrodes (34) and the phosphor panel (20). Exposure of the active devices on the driver panel to destructive high processing temperatures inherent in display panel processing is avoided.

10 Claims, 4 Drawing Sheets

ELECTROLUMINESCENT DISPLAY WITH INTEGRATED DRIVE CIRCUITRY

BACKGROUND OF THE INVENTION

1. Field of the Invention

The present invention relates generally to flat panel displays, and more particularly to an electroluminescent display and method which integrates a driver panel with a processed display panel to form an active-matrix electroluminescent display.

2. Description of the Related Art

Conventional electroluminescent displays use a passive-matrix or edge driven addressing scheme to energize a phosphor panel within the display. A typical passive-matrix electroluminescent display is described in S. Sherr, Electronic Displays §5.3.2 (2d ed. 1993). The phosphor panel is typically sandwiched between parallel row electrodes on one side of the phosphor panel and orthogonally placed parallel colur electrodes on the other side of the phosphor panel. A display element area is defined at each intersection of the row and column electrodes. A particular display element is activated by the concurrent application of voltage signals to the appropriate row and column electrodes.

Passive-matrix displays present a multitude of problems such as high power losses, slow data rates, and poor control of grey scale uniformity across the display elements of the matrix. The phosphor in electroluminescent displays typically requires a high voltage potential of between 160 and 210 volts for luminescence. This high voltage requirement, coupled with the fact that the row and column electrodes themselves define the display element areas, forces the electrodes to be relatively large in size. The large electrodes create highly resistive paths which leads to large power losses when addressing multiple display elements.

In addition to high power losses, the high resistance of the column and row electrodes results in poor control of grey scale uniformity across the display elements of the matrix. As discussed, each display element is driven by a shared row electrode and a shared column electrode. Consequently, as a particular voltage signal travels through each row and each column, the voltage signal level decreases in proportion to the resistance along the respective electrode path. As a result, a high voltage signal must be used to control grey scale modulation. In addition, the voltage signal applied to each display element varies significantly from one display element to voltage applied to each display element is critical, especially in high resolution displays with a large number of display elements.

Finally, passive-matrix displays generally suffer from slow operating speeds. The slow speed is caused in part by the large electrode size which must be used to address each display element. Further losses in speed are due to the activation of a given row only once per frame. Images on passive-matrix displays usually flicker at the frame rate because the display elements are on for only a fraction of the frame time. This can be unacceptable in high resolution video applications.

Active-matrix addressing differs from the passive-matrix structure described above by incorporating an active device, such as a switching transistor, at each display element. The active device reduces power losses by separating the electrode addressing circuitry from the actual electrodes, thus allowing the use of a smaller grey scale control voltage. Additionally, data rates are increased by a charge storage capability at each active device for providing longer "on time" for each display element. Finally, greater grey scale uniformity is provided by independent control of the voltage signal at each display element. An active-matrix display is discussed in greater detail in S. Morozumi, "Active-Matrix Displays," 2 Society For Information Display 10.1 (1989).

The incorporation of an active drive device at each display element represents a substantial increase in the complexity of electroluminescent displays. The need for a large number of interconnections between the active devices and the display panel makes the manufacture of external driver circuit architectures impractical.

SUMMARY OF THE INVENTION

The purpose of the present invention is to provide an electroluminescent display with reduced power requirements, increased data rates, and greater control of grey scale uniformity than existing passive-matrix or edge driven electroluminescent displays. The invention integrates an active driver panel with a processed electroluminescent display panel using a unique application of semiconductor wafer technology that avoids having to design and fabricate active driver devices which are able to withstand the high processing temperatures required for phosphor panel fabrication. The display and drive panels are independently fabricated and subsequently adhered together to form an integrated electroluminescent display.

In a preferred embodiment, the display panel includes a transparent front electrode formed on a glass substrate. The front electrode is positioned adjacent to a processed phosphor panel to produce a voltage potential across the phosphor panel. On the phosphor panel, selected portions of a phosphor layer, which is disposed between insulating layers provide luminescence in response to the application of an electric field across the phosphor panel. The driver panel preferably consists of a semiconductor wafer on which a microelectronic driver circuit is formed. A back electrode, also formed on the semiconductor wafer, is operatively connected to the driver circuit to provide a voltage potential across the phosphor panel. Multiple microelectronic driver circuits and respective back electrodes are formed on the wafer in an active-matrix configuration. A row driver and a column driver for addressing each microelectronic driver circuit may also be formed on the wafer.

Finally, the driver panel is adhered to the display panel using either an indium bump connection or a thermal bond to provide both mechanical and electrical coupling between the back electrodes and the phosphor panel.

In establishing an indium bump connection, indium bumps are formed on the back electrodes and/or the phosphor panel. Alternatively, if an overglass layer is applied over the back electrode to provide a planarized surface, the indium bumps may be formed on the overglass layer.

In creating a thermal bond, a first bonding insulating layer, formed on the phosphor panel, is thermally fused to a second bonding insulating layer on the driver panel at a temperature between 170° C. and 350° C.

These and other features and advantages of the invention will be apparent to those skilled in the art from the following detailed description, taken together with the accompanying drawings, in which:

DETAILED DESCRIPTION OF THE INVENTION

Figure 1:
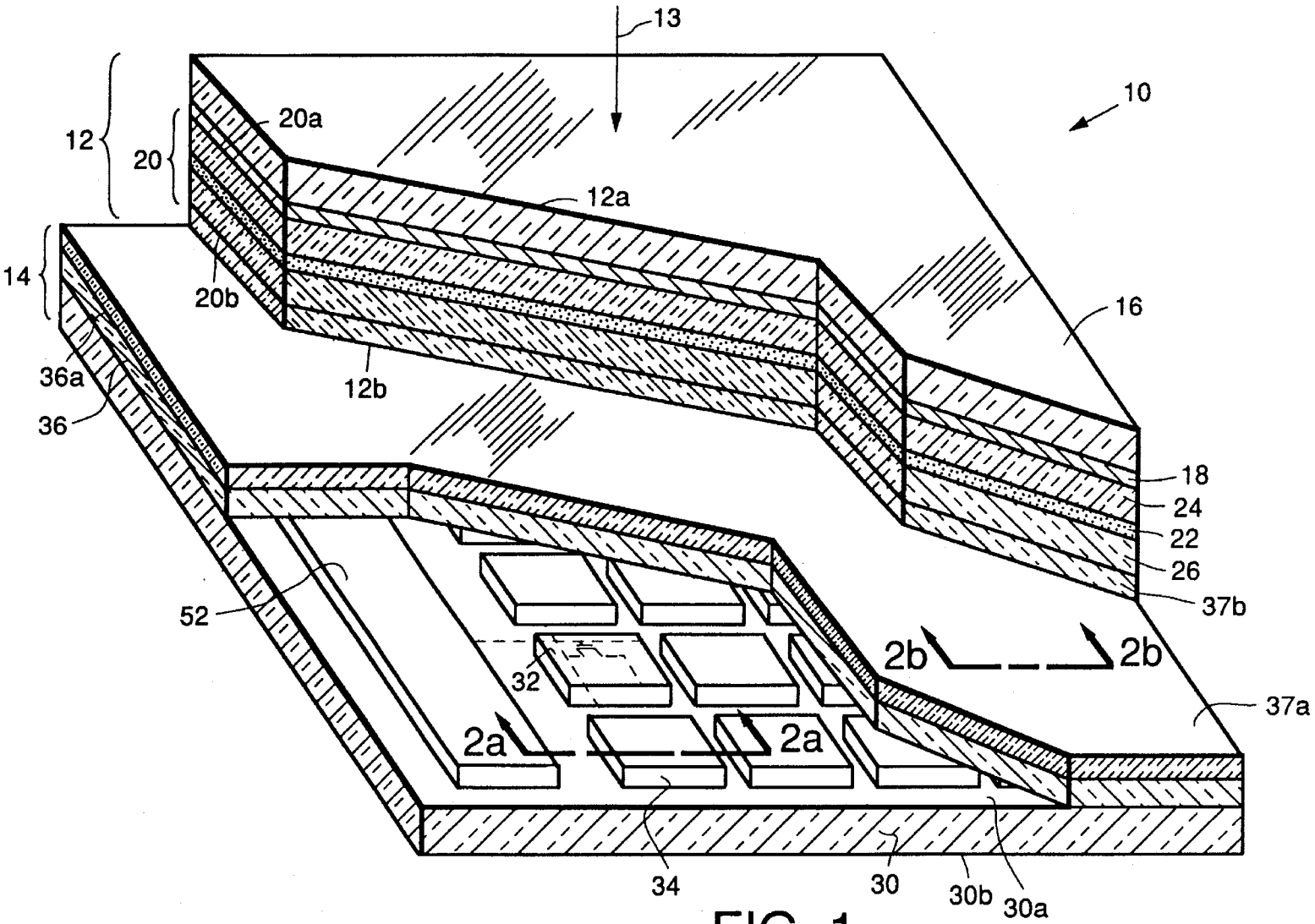
FIG. 1 is a cutaway perspective view illustrating an electroluminescent display embodying the present invention.

As illustrated in FIG. 1, an electroluminescent display 10 embodying the present invention includes a display panel 12 and a driver panel 14 for electrically driving the display panel 12. The display panel 12, which can be viewed from direction 13, includes a substrate 16 made of a transparent material such as glass. A front electrode 18, preferrably made of a transparent conductive material such as indium tin oxide (ITO), is formed on the inner surface of substrate 16. A phosphor panel 20, having a outer surface 20*a* and an inner surface 20*b*, is positioned along the opposite side of the front electrode 18 from substrate 16. The phosphor panel 20 is adhered to the front electrode 18 by a transparent adhesive.

The phosphor panel 20 includes an active medium such as a zinc sulfur based phosphor layer 22. The phosphor layer 22 preferably has a thickness of approximately 5000 angstroms and is sandwiched between a first insulating layer 24 and a second insulating layer 26. The insulating layers 24, 26 can be made from a dielectric material such as silicon dioxide, silicon nitrate, aluminum oxide, or titanium oxide. Preferably, insulating layers 24, 26 each have a thickness of between 2000 and 2500 angstroms.

The display panel 12 as described is available from commercial flat panel display suppliers such as Planar Systems Inc. of Beaverton, Oregon. The described display panel is the preferred embodiment of the invention, but other known types of display panels fabricated from a wide variety of other materials may be used within the scope of the invention.

The driver panel 14 consists of a semiconductor wafer 30 having an inner surface 30*a* and an outer surface 30*b*. The preferred material for the semiconductor wafer 30 is monocrystalline (single crystalline or bulk) silicon, although other semiconductor materials such as gallium arsenide, cadmium selenide or cadmium telluride may be used.

A microelectronic driver circuit 32, shown by dotted lines in FIG. 1, is formed on the inner surface 30*a* of semiconductor wafer 30 using standard microcircuit fabrication techniques. Alternatively, the microelectronic driver circuit 32 or portions thereof can be formed on the outer surface 30*b* of the semiconductor wafer 30 using similar fabrication techniques. In the latter case, electrical contact between the inner and outer surfaces 30*a* and 30*b* can be made with standard conductive interconnects (not shown) extending through the semiconductor wafer 30. The microelectronic driver circuit 32, and the fabrication thereof, is described in greater detail below in connection with FIG. 3.

A back electrode 34 is desposited on the inner surface 30*a* of the semiconductor wafer 30. Preferably, back electrode 34 is made of a high quality reflective aluminum which provides both conductivity as well as increased display brightness. The back electrode 34 is electrically connected to the microelectronic driver circuit 32. An insulating material (not shown) may be used to prevent undesirable shorting between the microelectronic driver circuit 32 and the back electrode 34.

Multiple back electrodes 34 and microelectronic driver circuits 32 can be arranged in any desired configuration. Additional circuitry, such as row driver 52 and column driver 56, can also be formed on semiconductor wafer 30 for matrix addressing of microelectronic driver circuits 32.

In the preferred configuration as illustrated in FIG. 1, the back electrodes 34 and respective microelectronic driver circuits 32 are arranged in a matrix array to form an active-matrix electroluminescent display (AMEL). Any number of back electrodes 34 and respective driver circuits 32 can be used. A practical display might include, for example, 1,310,720 back electrodes 34 and driver devices 32 arranged in a 1,280×1,024 matrix.

Alternatively, although not illustrated, the back electrodes 34 can be arranged as segments which are selectively activated to form numerals or alphanumeric characters, or as an array not ordered in rows and columns, but in other patterns.

An overglass layer 36 is preferably deposited or formed over the back electrodes 34. The overglass layer 36 is preferably made of any dielectric material of the types mentioned above. The overglass layer 36 provides a planarized surface 36*a* for enhancing the adhesion or bonding of the driver panel 14 to the display panel 12. The driver panel 14 is adhered to the display panel 12 to provide electrical and mechanical coupling between the back electrodes 34 and the inner surface 20*b* of phosphor panel 20.

In the embodiment illustrated in FIG. 1, electrical and mechanical coupling between the display and driver panels 12 and 14 is accomplished using a thermal bond. A first bonding insulating layer 37*a* is formed on the inner surface 36*a* of the overglass layer 36. If an overglass layer 36 is not used, the first bonding insulating layer 37*a* is formed directly over back electrodes 34 on the inner surface 30*a* of semiconductor wafer 30. A second bonding insulating layer 37*b* is formed on the inner surface 20*b* of phosphor panel 20. Insulating layers 37*a*, 37*b* can be formed from any dielectric material of the type mentioned above, but are preferably silicon dioxide or silicon nitrate having a thickness of approximately 500 angstroms.

The first bonding insulating layer 37*a* is thermally fused to the second bonding insulating layer 37*b*. The fusion between layers 37*a* and 37*b* provides both a strong mechanical bond between the driver panel 14 and the display panel 12, and capacitive coupling between the back electrodes 34 and the inner surface 20*b* of the phosphor panel 20.

Figure 2A:
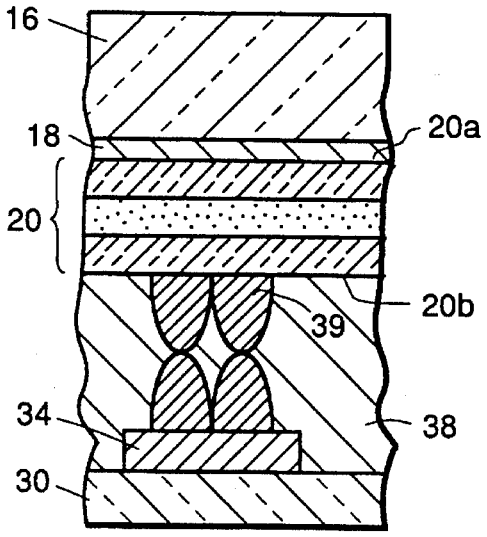
FIG. 2A is a sectional view of a portion of the display, taken at line 2—2 of FIG. 1, showing one embodiment of the indium bump connection.
Figure 2B:
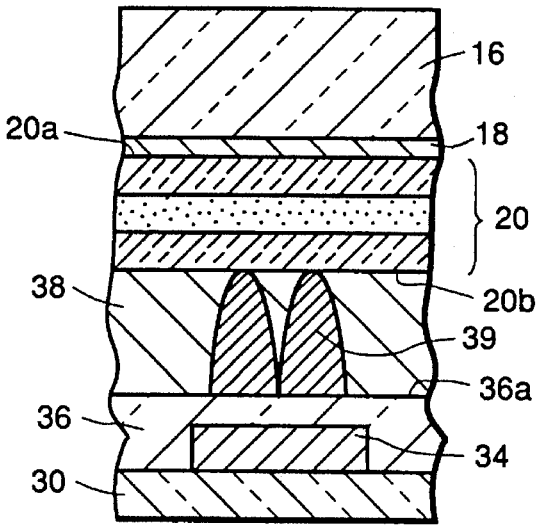
FIG. 2B is a sectional view of a portion of the display, taken at line 2—2, showing a second embodiment of the indium bump connection.

Alternate embodiments of the present invention are shown in FIGS. 2A and 2B. The embodiment of FIG. 2A establishes direct resistive coupling and mechanical adhesion between the display and driver panels through indium bump connections 38. The indium bumps 39 can be fabricated directly on the back electrodes 34 and/or inner surface 20*b* of the phosphor panel 20. Alternatively, if an overglass layer 36 is desired for planarization, the indium bumps 39 may be fabricated directly on the inner surface 36*a* of the overglass layer 36 as shown in the embodiment of FIG. 2B. In such cases, the overglass layer 36 between the indium bumps 39 and the back electrodes 34 acts as a series capacitance.

Figure 3:
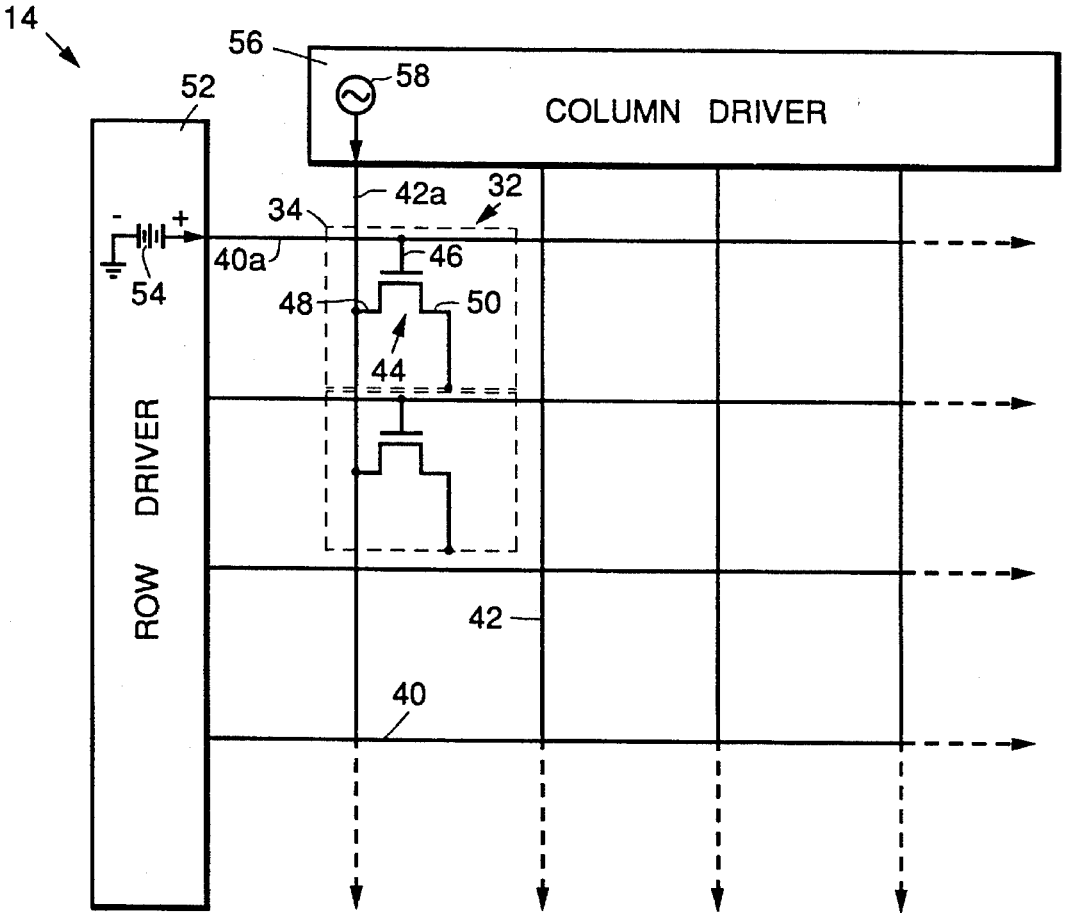
FIG. 3 is a schematic diagram of the active matrix driver panel, particularly illustrating the interconnections between the microelectronic driver device, column bus lines, and row bus lines.

An equivalent schematic diagram of the driver panel 14 is shown in FIG. 3. Multiple microelectronic driver circuits 32 and respective back electrodes 34, shown in dotted lines, are arranged in a square matrix configuration. Each microelectronic driver circuit 32 includes a row bus line 40, a column bus line 42, and a microelectronic driver device 44. The bus lines 40, 42 may be made of aluminum or other suitable metallizations, or alternatively may be formed as heavily doped, electrically conductive lines in the material of the semiconductor wafer 30. The microelectronic driver device 44 is preferably a high voltage thin film MOSFET transistor, although other types of transistor devices or configurations may be used.

A respective row bus line 40a is connected to the gate 46 of microelectronic drive device 44. The respective column bus line 42*a* is connected to the source 48 of the microelectronic driver device 44, and the drain 50 of the microelectronic driver device 44 is connected to the respective back electrode 34. Additionally, a storage capacitor (not shown) may be added between the drain 50 and ground reference for powering the electrode after the driver device 44 has been turned off.

Row driver 52 and column driver 56 microelectronic circuits may be fabricated directly on the inner surface 30*a* of semiconductor wafer 30*b*. The circuits 52 and 56 are fabricated at the same time as, and using the same processing technology as, the microelectronic driver circuits 32. External connections to circuits 52 and 56 can be made through electrical interconnects (not shown) extending through semiconductor wafer 30. Alternatively, circuits 52 and 56 may be fabricated on the outer surface 30b of semiconductor wafer 30 or on an external substrate that is electrically connected to the wafer's outer surface 30*b*.

In addition to including row driver 52 and column driver 56, other integrated microcircuits can be integrated which provide clock, partitioning, housekeeping and other functions. This enables substantially all of the microelectronic circuitry for the electroluminescent display 10 to be integrally fabricated on the display.

Row driver 52 sequentially applies a select signal 54 to the row bus lines 40. Column driver 56 applies a data signal 58 to the column bus lines 42 which determines the voltage level applied to the back electrodes 34, and thus the corresponding illumination of the phosphor panel 20. The row bus lines 40 are sequentially scanned to generate a graphic image.

The select signal 54, applied to the row bus line 40a through row driver 52, provides the necessary voltage to the gate 46 for turning on the driver device 44. During the time in which the select signal 54 is applied to gate 46, driver device 44 provides a low impedance path between the source 48 and the drain 50. The data signal 58, simultaneously applied to the column bus line 42*a* through column driver 56, travels through the driver device 44 to back electrode 34. The data signal 58 is preferably a variable value in proportion to the grey scale level to be displayed on phosphor panel 20.

The back electrodes 34 are individually and selectively switched to a range of voltages as described above. When a voltage potential, and thus an electric field, is created between the back electrode 34 and the front electrode 18, the phosphor layer 22 illuminates. More specifically, the application of a voltage potential causes electrons at the negatively-biased electrode to gain enough kinetic energy to impact and thereby excite the phosphor 22, causing it to luminesce.

Figure 4:
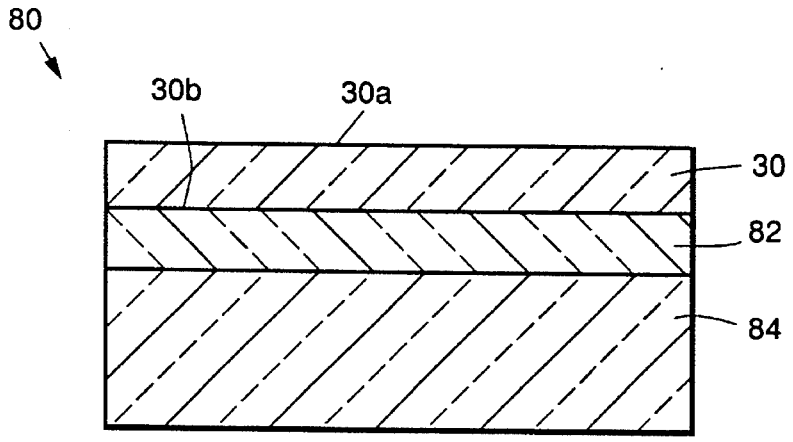
FIGS. 4–8 are simplified sectional views illustrating a method of fabricating the display according to the present invention.
Figure 8:
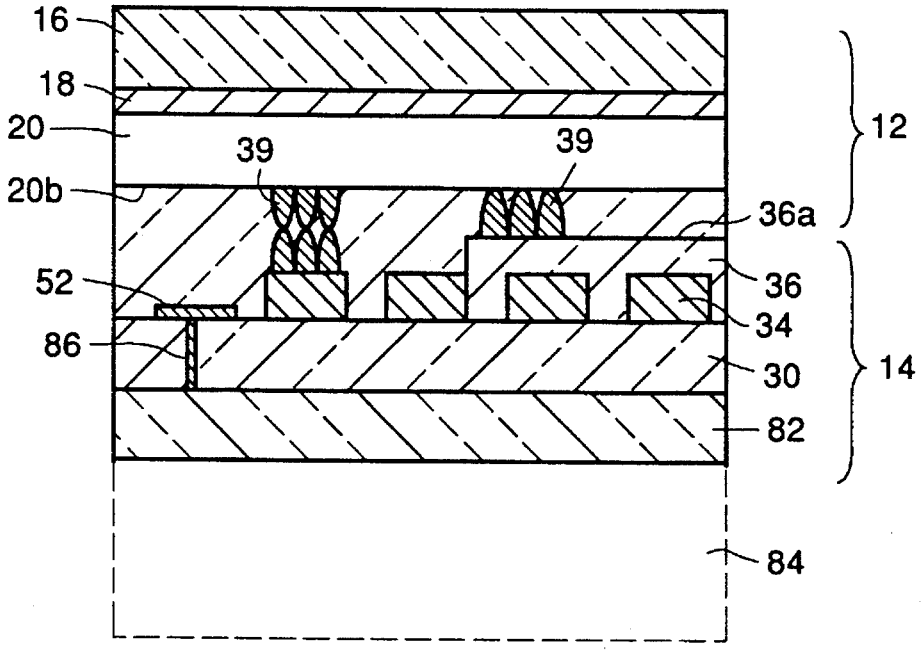

A preferred method of fabricating the electroluminescent display 10 is illustrated in FIGS. –8. In FIG. 4, a bonded structure 80 is provided, consisting of the semiconductor wafer 30 with an oxide layer 82 formed on its outer surface 30*b*. A carrier substrate 84 is thermally fused to the wafer's inner surface 30*b* using the oxide layer 82 as the bonding medium. Preferably, the thermal fusion is accomplished at a temperature of approximately 1000° C.

The semiconductor wafer 30 has a thickness of approximately 2–8 micrometers, which allows for double sided fabrication and enhanced performance as is known in the art. The carrier substrate 84 is preferably formed of silicon with a thickness of approximately 500 micrometers, making it sufficiently durable to support the semiconductor wafer 30 through standard processing steps. The oxide layer 82 is typically silicon dioxide having a thickness of approximately one micrometer. A bonded structure 80 which is suitable for practicing the present invention is commercially available from many suppliers, such as Shinetsu Handotai of Tokyo, Japan.

Figure 5:
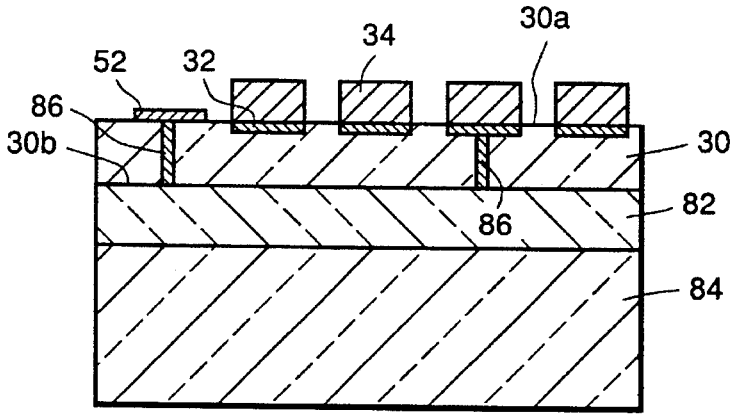

At the next stage of fabrication, illustrated in FIG. 5, microelectronic driver circuits 32 which include the microelectronic driver devices 44, row bus lines 40, and column bus lines 42, are fabricated on the inner surface 30*a* of semiconductor wafer 30 using standard microcircuit fabrication techniques. It is to be understood that microelectronic driver circuits 32, or portions thereof, may alternatively be fabricated on the outer surface 30*b* of semiconductor wafer 30. In the latter case, electrical interconnects 86 are formed through the semiconductor wafer 30 from the driver circuits 32.

The electrical interconnects 86 are created by patterning the inner surface 30*a* of the semiconductor wafer 30 and etching openings using conventional photolithographic processing. A metal is deposited in each opening to form the interconnects 86, which provide electrical contacts from the inner surface 30*a* to the outer surface 30*b* of the semiconductor wafer 30.

Additionally, row drivers 52 and column drivers 56 can be fabricated on the wafer's inner surface 30*a* using the same standard fabrication techniques as discussed above. Additional microelectronic devices or structures may also be fabricated on the wafer's inner surface 30*a* .

In FIG. 5, the back electrodes 34 are also deposited on the wafer's inner surface 30*a* . The back electrodes 34 may need to be sufficiently insulated (not shown) from the driver circuit 32 to avoid undesirable shorting between them.

Figure 6:
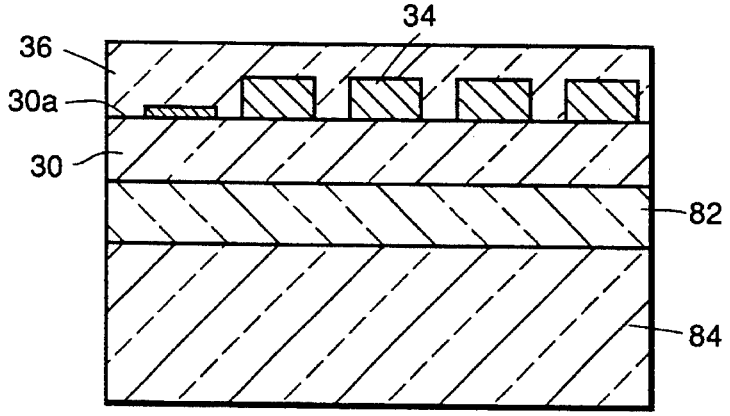

An overglass layer 36 can also be deposited on the wafer's inner surface 30*a* , as shown in FIG. 6. This step is optional, but creates a planarized surface that enhances the bonding between the driver panel 14 and the display panel 12.

The fabrication process for a typical phosphor panel 20 requires an annealing temperature of between 500° C. and 1000° C. Microelectronic driver circuits 32 made from semiconductor material are not able to withstand these elevated processing temperatures and must be independently fabricated and subsequently integrated with the phosphor panel 20 at a much lower temperature.

Figure 7:
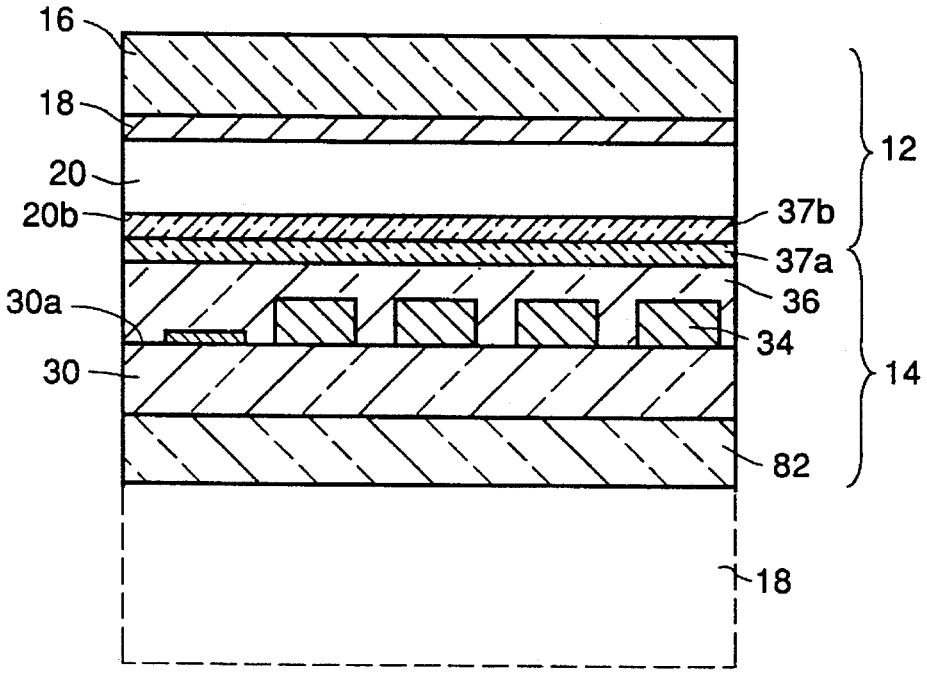

FIGS. 7 and 8 illustrate two low temperature methods of adhering the wafer's inner surface 30*a* to the phosphor panel's inner surface 20*b*. In one method, the wafer's inner surface 30*a* is thermally bonded to the phosphor panel's inner surface 20*b*. The thermal bonding process, illustrated in FIG. 7, includes forming a first bonding insulating layer 37a on the wafer's inner surface 30*a* and a second bonding insulating layer 37*b* on the phosphor panel's inner surface

20*b*. The first bonding insulating layer 37*a* is then thermally fused to the second bonding insulating layer 37*b* at a temperature between 170° C. and 350° C., and preferably at 200° C. in an oxygen environment. This low temperature fusion bonding process prevents destruction of the processed semiconductor driver circuit 32.

Another method of adhering the semiconductor wafer 30 to the display panel 20 is to indium bump connect the back electrodes 34 to the phosphor panel's inner surface 20*b*. As shown in FIG. 8, the indium bumps 39 are deposited directly on either or both the back electrodes 34 and the second surface 20*b* of phosphor panel 20. If an overglass layer 36 is used, the indium bumps can be deposited on the inner surface 36*a* of the overglass layer 36. The driver panel 14 and display panel 12 are then pressed together, with or without the intermediary of an adhesive, to form both electrical and mechanical coupling.

In the final step, the carrier 84 is removed using well known etching techniques. This completes the integration of the driver circuit 14 with the display panel 12. Additional microelectronic driver circuits 32 (not shown) can be subsequently formed on the wafer's outer surface 30*b* as desired.

While preferred embodiments of the invention have been shown and described, numerous variations and alternate embodiments will be apparent to those skilled in the art. Accordingly, it is intended that the invention be limited only in terms of the appended claims.

I claim:

1. An integrated electroluminescent display comprising:

(a) a display panel, wherein said display panel comprises:

a substrate;

a front electrode array formed on said substrate; and a phosphor panel having an outer surface and an inner surface, said outer surface positioned adjacent said front electrode array;

(b) a driver panel for electrically driving said display panel, wherein said driver panel comprises:

a semiconductor wafer having an inner surface;

a microelectronic driver circuit formed on said semiconductor wafer; and a back electrode array deposited on said inner surface of said wafer and operatively connected to said microelectronic driver circuit and wherein said back electrode array is electrically coupled to said display panel; and (c) a plurality of bumps for electrically coupling said back electrode array of said driver panel to said display panel, wherein at least some of said bumps are in contact with said inner surface of said phosphor panel and extend towards said back electrode array.

2. A device as recited in claim 1, wherein said bumps are indium bumps.

3. A device as recited in claim 1, wherein said phosphor panel comprises:

a first insulating layer;

a second insulating layer spaced from said first insulating layer; and a phosphor layer disposed between said first insulating layer and said second insulating layer.

4. A device as recited in claim 1, wherein at least some of said bumps extend from said back electrode array and make contact with said bumps extending from said inner surface of said phosphor panel.

5. A device as recited in claim 1, further comprising an overglass layer formed on said inner semiconductor wafer surface over said back electrode array, wherein said bumps extending from said panel are also in contact with said overglass layer.

6. A device as recited in claim 1, wherein said microelectronic driver circuit comprises a plurality of microelectronic driver circuits and said back electrode array comprises a plurality of back electrodes, said plurality of said driver circuits and said back electrodes arranged in a matrix configuration.

7. A device as recited in claim 1, wherein said microelectronic driver circuit comprises:

a microelectronic driver device;

a row bus line for electrically controlling the operation of said microelectronic driver device; and a column bus line for electrically communicating a signal through said microelectronic driver device to said back electrode.

8. A device as recited in claim 1, wherein said semiconductor wafer is a monocrystalline silicon wafer.

9. A method of fabricating an electroluminescent display from a display panel and a driver panel, comprising the step of mechanically and electrically coupling said display panel to said driver panel by thermally bonding said driver panel to said display panel, wherein said thermal binding strip comprises:

forming a first layer of bonding insulating material on an inner surface of said driver panel;

forming a second layer of bonding insulating material on an inner surface of said display panel; and thermally fusing together said first and second bonding insulating layers.

10. The method of claim 9, further comprising the step of forming an overglass layer between said inner surface of said driver panel and said first layer of bonding insulating material.

* * * * *